United States Patent [19]

Anyan et al.

[11] Patent Number: 4,979,569

[45] Date of Patent: Dec. 25, 1990

[54] DUAL ACTION VALVE INCLUDING AT LEAST TWO PRESSURE RESPONSIVE MEMBERS

[75] Inventors: Steven L. Anyan, Sugarland, Tex.; Vaughn D. Kennemer, Elk City, Okla.; Richard G. Lewis, Houlma, La.

[73] Assignee: Schlumberger Technology Corporation, Houston, Tex.

[21] Appl. No.: 364,402

[22] Filed: Jul. 6, 1989

[51] Int. Cl.[5] ..... E21B 34/10; E21B 43/12; E21B 49/08

[52] U.S. Cl. ..... 166/374; 137/70; 166/317; 166/332; 166/264; 251/62

[58] Field of Search ..... 166/374, 375, 317, 332, 166/319, 264, 120, 212; 251/58, 62, 56, 304; 137/70, 71, 68.1

[56] References Cited

U.S. PATENT DOCUMENTS

| | | | |
|---|---|---|---|
| Re. 29,638 | 5/1978 | Nutter | 73/151 |
| 3,821,962 | 7/1974 | Mott | 166/332 X |
| 3,871,450 | 3/1975 | Jett et al. | 251/62 X |
| 3,887,007 | 6/1975 | Abney et al. | 166/319 |
| 4,144,937 | 3/1979 | Jackson et al. | 166/332 X |
| 4,349,175 | 9/1982 | Akkerman et al. | 251/31 |
| 4,440,230 | 4/1984 | McGill | 166/321 |
| 4,474,242 | 10/1984 | Upchurch | 116/323 |
| 4,513,764 | 4/1985 | Yonker | 166/319 X |
| 4,519,576 | 5/1985 | Winegeart | 251/62 |
| 4,553,598 | 11/1985 | Meek et al. | 166/317 |
| 4,576,234 | 3/1986 | Upchurch | 166/319 |
| 4,597,439 | 7/1986 | Meek | 166/264 |
| 4,610,308 | 9/1986 | Meek | 166/321 |
| 4,618,000 | 10/1986 | Burris, II | 166/317 X |
| 4,688,634 | 8/1987 | Lustig et al. | 166/120 |
| 4,721,157 | 1/1988 | Berzin | 166/169 |

*Primary Examiner*—Stephen J. Novosad

*Attorney, Agent, or Firm*—Henry N. Garrana; John H. Bouchard

[57] ABSTRACT

A valve in a tool may be opened and closed by sequential application of a first predetermined annulus pressure and a second predetermined annulus pressure. A first rupture disc ruptures when the first predetermined annulus pressure is applied to the well annulus thereby allowing such pressure to be applied against a surface of an operator and moving the mandrel. This moves a yoke connected to the valve, opening the valve. A second rupture disc ruptures when the second predetermined annulus pressure is applied to the well annulus thereby allowing such pressure to be applied against a surface of a collet mandrel, moving the collet mandrel in a direction opposite to the direction in which the operator mandrel originally moved. Since the collet mandrel is connected to the operator mandrel and to the yoke, movement of the collet mandrel in the opposite direction moves the operator mandrel and the yoke in the opposite direction, thereby closing the valve. Since the two rupture discs are designed to rupture in response to two different pressures, the sequential application of the first and second predetermined pressures to the well annulus sequentially opens and closes the valve.

19 Claims, 2 Drawing Sheets

FIG. 1
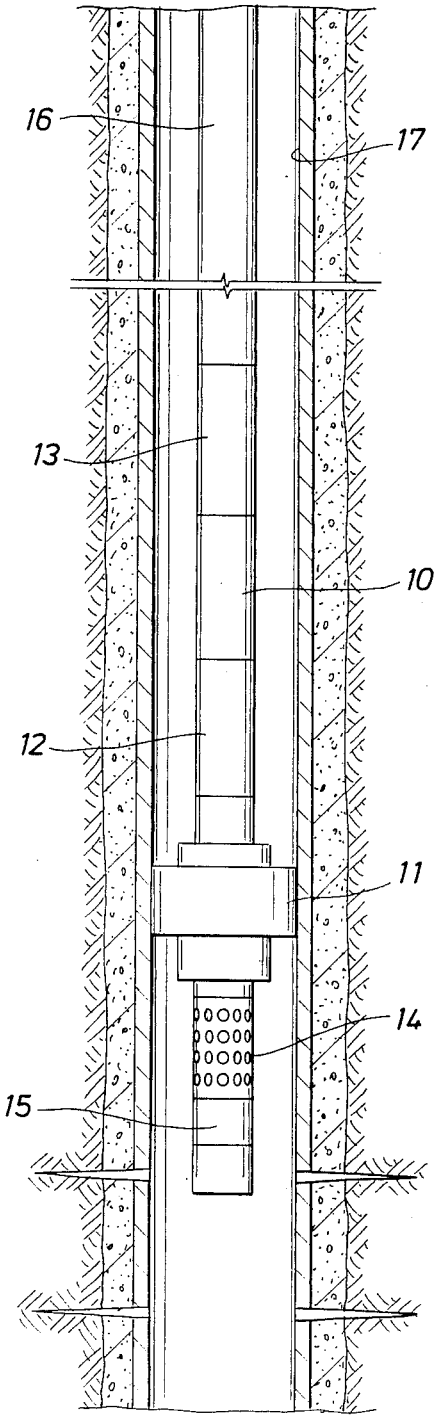
FIG. 2
| |
|---|
| FIG. 2A |
| FIG. 2B |
| FIG. 2C |
FIG. 2A
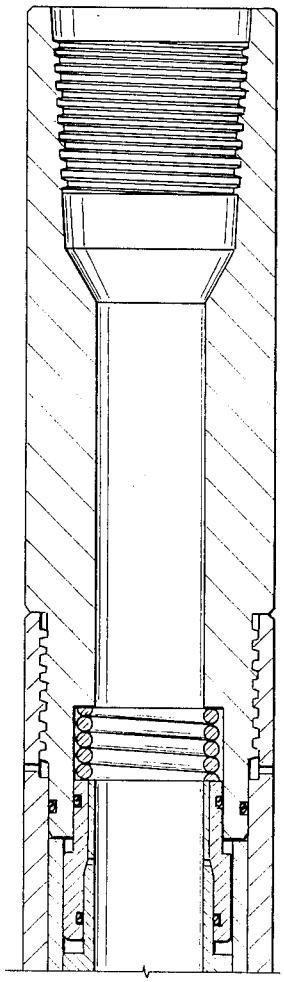

DUAL ACTION VALVE INCLUDING AT LEAST TWO PRESSURE RESPONSIVE MEMBERS

BACKGROUND OF THE INVENTION

The subject matter of the present invention pertains to well bore apparatus, and more particularly, to a dual action valve for use in the well bore apparatus including at least two pressure responsive members.

Well bore apparatus for use in conjunction with oil exploration typically includes perforating apparatus and drill stem testing apparatus. The perforating apparatus includes perforating guns for perforating a formation in a borehole and the drill stem testing apparatus including two valves and at least two mechanisms, one mechanism for opening one valve and another mechanism for closing the other valve. When the perforating gun perforates the formation, and the well fluids begin to flow, it is necessary to open a valve to permit the well fluids to flow to the well surface. Therefore, the first mechanism opens the first valve. The pressure associated with a flow of the well fluids to the surface, termed "flow pressure", is measured. The first valve must remain open, since there is no way to close the first valve. However, a further pressure test, termed a "shut in test", must yet be performed, this test requiring a closed valve. Therefore, the second mechanism closes the second valve. When the second valve is closed, the increase in pressure of the well fluids at the second valve, termed the "shut in pressure", indicative of the formation pressure, is measured. However, the apparatus required to measure the flow pressure and the shut in pressure of the well fluids included at least two tools, a first tool including the first mechanism and the first valve, and a second tool including the second mechanism and the second valve. The first mechanism in the first tool opened the first valve to measure the flow pressure, and the second mechanism in the second tool closed the second valve to measure the shut in pressure. The first and second mechanisms each include a !rupture disc. A first rupture disc in the first tool was set to rupture when a first predetermined annulus pressure was exceeded, and a second rupture disc in the second tool was set to rupture when a second predetermined annulus pressure was exceeded. Since each tool possessed only one rupture disc, it was required that the tool be run into the well bore or borehole with its valve being either initially open or initially closed. When a pressure test required both an initially open and an initially closed valve (e.g., to sequentially measure flow pressure and shut in pressure), two tools were run into the borehole, one tool having the initially closed valve with a rupture disc set to rupture in response to a first predetermined annulus pressure, and another tool having the initially open valve with a rupture disc set to rupture in response to a second predetermined annulus pressure Other systems included a different mechanism for opening and closing a valve. In these systems, one valve, associated with one tool, is opened or closed, selectively. However, rupture discs were not used. Instead, annulus pressure is increased, which pressure is applied against one surface of a piston, the other surface of the piston being subject to another pressure which is a result of a contact with a liquid or gas disposed within a cavity. When the annulus pressure is increased to a point where a pressure force on the one surface of the piston exceeds the pressure force on the other surface of the piston, the piston moves in a direction which may open the valve; when the annulus pressure is reduced, the pressure force on the other surface of the piston moves the piston in an opposite direction thereby closing the valve. If the annulus pressure is accidentally reduced, the valve closes at a time when an open valve is required. In addition, since rupture discs are not utilized, the pressure needed to open the valve is not precisely known; the only way to close the valve involves bleeding off the annulus pressure, whereby the pressure required to close the valve is also not known with any kind of certainty. A system or method is needed to selectively open or close at least one valve in one tool with some measure of precise certainty in regards to the pressure needed to open the valve and the pressure needed to close the valve.

SUMMARY OF THE INVENTION

It is a primary object of the invention to design a tool having one valve adapted to be opened or closed, and a means for opening the valve in response to a precise first pressure and a means for closing the valve in response to a precise second pressure.

It is a further object of the present invention to provide one tool containing at least one valve adapted to move to an open and a closed position, and a pressure responsive means for opening the valve to implement the flow pressure test in response to a first predetermined annulus pressure and for closing the valve to implement the shut in pressure test in response to a second predetermined annulus pressure.

It is a further object of the present invention to provide one tool containing the pressure responsive means, which pressure responsive means comprises two rupture discs, one rupture disc designed to open a valve and another rupture disc designed to close the valve.

These and other objects of the present invention are achieved by designing and providing a tool which includes a valve operable between a first state and a second state, a movable operator mandrel connected to the valve, a collet mandrel connected to the valve via the operator mandrel, a first rupture disc adapted to rupture in response to a first pressure and a second rupture disc adapted to rupture in response to a second pressure. The operator mandrel is responsive to pressure applied thereto in response to rupture of the first rupture disc for moving the operator mandrel and collet mandrel from a first position to a second position thereby changing the state of the valve from the first state to the second state. The collet mandrel is responsive to a further pressure applied thereto in response to rupture of the second rupture disc for moving the collet mandrel and the operator mandrel from the second position to the first position thereby changing the state of the valve from the second state to the first state. As a result, one tool, containing at least one valve, includes two pressure responsive members, one member designed to open the valve, and the other designed to close the valve. It is no longer necessary to provide two tools for opening and closing the valve for the purpose of performing the flow pressure test and the shut in pressure test.

Further scope of applicability of the present invention will become apparent from the detailed description presented hereinafter. It should be understood, however, that the detailed description and the specific examples, while representing a preferred embodiment of the present invention, are given by way of illustration only, since various changes and modifications within the spirit and scope of the invention will become obvious to one skilled in the art from a reading of the following detailed description.

BRIEF DESCRIPTION CF THE DRAWINGS

A full understanding of the present invention will be obtained from the detailed description of the preferred embodiment presented hereinbelow, and the accompanying drawings, which are given by way of illustration only and are not intended to be limitative or the present invention, and wherein:

FIG. 1/illustrates a typical tool string disposed in a borehole;

FIG. 2, including FIGS. 2*a*–2*c*, illustrates a portion of the tool string of FIG. 1 containing the dual action valve of the present invention; and FIG. 3 illustrates in greater detail the construction of each of the rupture discs shown in FIG. 2B.

DETAILED DESCRIPTION OF THIS PREFERRED EMBODIMENT

Figure 2B:
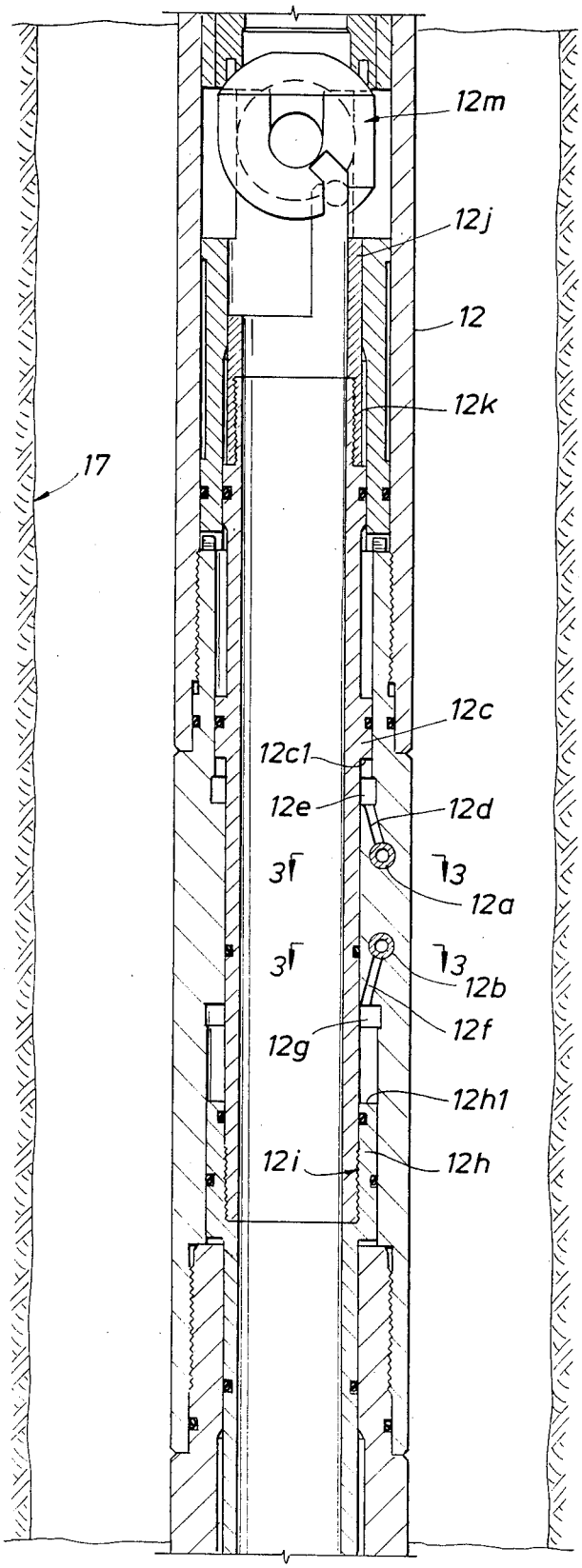

Referring to FIG. 1, a typical tool string disposed in a borehole is illustrated. In FIG. 1, a fluid sampler 10 is interposed between a test valve 12 and a reversing valve 13. The reversing valve 13 is further connected to a tubing string 16, and the test valve 12 is connected to a packer 11. A perforated tail pipe 14 is dependently coupled to packer 11. A suitable housing 15 is coupled to the tail pipe 14 for enclosing one or more pressure recorders for acquiring a record of the pressure variations in an isolated portion of the well bore 17, below the packer 11, during drillstem testing operations. The pressure recorders comprise pressure gauges for measuring and recording the flowing and shut-in pressure of the fluids in the formation A more complete description of FIG. 1 may be found in U.S. Pat. No. 4,597,439, entitled "Full Bore Sample Collecting Apparatus", the disclosure of which is incorporated by reference into this specification.

Figure 2C:
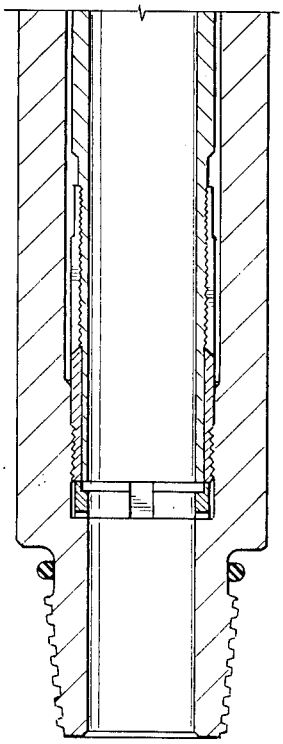

Referring to FIGS. 2A through 2C, a detailed construction of a portion of the tool string of FIG. 1 is illustrated.

In FIG. 2, note that FIG. 2B is an intermediate part disposed between FIG. 2A and FIG. 2C. Since FIG. 2B is the most important part of the invention, attention will be focused on the FIG. 2B part of FIG. 2.

The tool shown in FIG. 2 is intended to replace the test valve 12 shown in FIG. 1. The test valve 12 is normally opened to allow formation fluid to flow into the tool of FIG. 1 via the slotted tail pipe 14. The flow pressure is measured via the pressure gauges housed within housing 15. The test valve 12 is then closed, allowing a shut-in pressure to build up within the tool of FIG. 1 below the test valve 12, and the shut in pressure is measured by the pressure guages housed in housing 15. In the present invention, the test valve 12 is not closed by bleeding off the annulus pressure; rather, the test valve 12 is opened in response to the application of a precise and certain first pressure applied to the well annulus and is subsequently closed in response to the application of a precise and certain second pressure applied to the well annulus, where the first pressure is different than the second pressure. The test valve 12 is opened and closed by using two rupture discs in one tool to sequentially move a mandrel, one rupture disc rupturing in response to the first pressure thereby allowing the first pressure to move the mandrel in one direction thereby opening the valve, the other rupture disc rupturing in response to the second pressure thereby allowing the second pressure to move the mandrel in another direction whereby closing the valve. A rupture disc ruptures in response to application thereto of a specific and precise pressure. If two rupture discs are used in one tool, to open and close one valve, and the rupture discs are each designed to rupture in response to application of different pressures, the valve will sequentially open and close in response to sequential application of the two different pressures to the well annulus.

In FIG. 2B, a first rupture disc **12*a* blocks fluid communication between a channel 12*d* and the annulus area between valve 12 and the wellbore 17. The channel 12*d* provides fluid communication to a first cavity 12*e*, which cavity 12*e* is in fluid communication with a surface 12*c*1 of an operator mandrel 12*c*. A second rupture disc 12*b* blocks fluid communication between a further channel 12*f* and the same annulus area between valve 12 and the wellbore 17. The further channel 12*f* provides fluid communication to a second cavity 12*g*, which second cavity 12*g* is in fluid communication with a surface 12*h*1 of a collet mandrel 12*h*. The surface area of surface 12*h*1 is greater than the surface area of surface 12*c*1, as illustrated in FIG. 2B. The first rupture disc 12*a* is designed to rupture in response to an application thereto of a first predetermined pressure, which first predetermined pressure originates from the annulus area around the valve. The second rupture disc 12*b* is designed to rupture in response to an application thereto of a second predetermined pressure, which second predetermined pressure originates from the annulus area, and is greater than the first predetermined pressure. The first and second predetermined pressures are sequentially applied to the annulus area by an operator at the well surface. The collet mandrel 12*h* is threadedly connected to one end of the operator mandrel 12*c* via threads 12*i*. The other end of the operator mandrel 12*c* is threadedly connected to one end of a yoke 12*j* via threads 12*k*. The other end of yoke 12*j* is connected to a ball valve 12*m*. Movement of the yoke 12*j* up and down in the FIG. 2B opens and closes the ball valve 12*m***.

Figure 3:
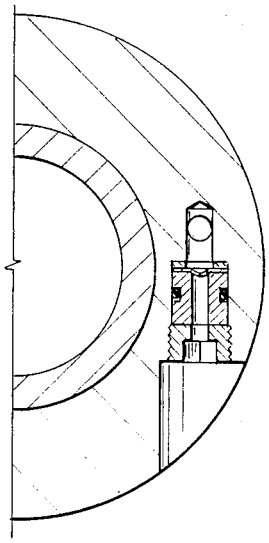

FIG. 3 illustrates in greater detail the construction of each rupture disc **12*a* and 12*b***.

A functional operation of the present invention will be set forth in the following paragraphs with reference to FIGS. 1 and 2B of the drawings.

In FIG. 2B, an operator at the well surface applies a first predetermined pressure to the annulus area between the tool of FIG. 1 (in particular, the test valve 12) and the wellbore 17. This first predetermined pressure exceeds a rated pressure value of the first rupture disc **12*a*, the rated pressure value being defined as that pressure above which the rupture disc will rupture. Therefore, the first rupture disc 12*a* ruptures. When the rupture disc 12*a* ruptures, the first predetermined pressure is communicated to surface 12*c*1 of the operator mandrel 12*c*. This pressure is enough to move the mandrel 12*c* upwardly in the FIG. 2B. The movement of mandrel 12*c* moves yoke 12*j* in the same direction, since yoke 12*j* is connected to mandrel 12*c*. Movement of yoke 12*j* in this direction opens the ball valve 12*m* Since the second rupture disc 12*b* has a rated pressure value which is different than the rated pressure value of the first rupture disc 12*a*, the second rupture disc 12*b* fails to rupture when the first predetermined pressure is applied to the annulus area by the operator. However, then the operator subsequently applies a second predetermined pressure to the annulus area, the second rupture disc 12b ruptures thereby communicating the second predetermined pressure to the surface 12h1 of the collet mandrel 12h. Since the collet mandrel 12h and the operator mandrel 12c are connected via threads 12i, and since the surface area of surface 12h1 is greater than the surface area of surface 12c1, application of the second predetermined pressure, greater than the first predetermined pressure, to the surface 12h1 of collet mandrel 12h moves the collet mandrel 12h and therefore the operator mandrel 12c downwardly in the FIG. 2B. Since the yoke 12j is connected to the operator mandrel 12c, yoke 12j will also move downwardly in the FIG. 2B, thereby closing the ball valve 12m. Consequently, one valve, 12m, in one tool 12, is opened in response to application of a precise and certain first predetermined pressure to the annulus area of the tool 12** and is closed in response to application of a precise and certain second predetermined pressure to the annulus area of the tool.

The invention being thus described, it will be obvious that the same way be varied in may ways. Such variations are not to be regarded as a departure from the spirit and scope of the invention, and all such modifications as would be obvious to one skilled in the art are intended to be included within the scope of the following claims.

I claim:

1. Apparatus for moving a mandrel, comprising:

first pressure responsive member means responsive to a first pressure for allowing said first pressure to pass through said first pressure responsive member means when said first pressure exceeds a first predetermined threshold pressure value, means responsive to said first pressure for moving said mandrel in one direction when said first pressure passes through said first pressure responsive member means; and second pressure responsive member means responsive to a second pressure for allowing said second pressure to pass through said second pressure responsive member means when said second pressure exceeds a second predetermined threshold pressure value which is greater than said first pressure, means responsive to said second pressure for moving said mandrel in another direction when said second pressure passes through said second pressure responsive member means.

2. The apparatus of claim 1, wherein said first pressure responsive member means comprises a first rupture disc, said first rupture disc being rated to rupture when said first pressure on said first rupture disc exceeds a value equal to said first predetermined threshold pressure value, said first pressure moving said mandrel in said one direction when said first rupture disc ruptures.

3. The apparatus of claim 2, wherein said second pressure responsive member means comprises a second rupture disc, said second rupture disc being rated to rupture when said second pressure on said second rupture disc exceeds a value equal to said second predetermined threshold pressure value, said second pressure moving said mandrel in said another direction when said second rupture disc ruptures.

4. The apparatus of claim 3, wherein said mandrel is disposed in a well tool adapted to be disposed in a borehole.

5. The apparatus of claim 4, further comprising a valve, said mandrel being connected to said valve, said mandrel opening said valve when said mandrel moves in said one direction, said mandrel closing said valve when said mandrel moves in said another direction.

6. The apparatus of claim 5, wherein said mandrel comprises an operator mandrel and a collet mandrel threadedly connected to said operator mandrel.

7. A method of moving a mandrel sequentially in a first direction and in a second direction, comprising the steps of:

(a) exerting a first pressure on a first pressure responsive member;

(b) when said first pressure equals or exceeds a first threshold value, allowing said first pressure to pass through said first pressure responsive member;

(c) exerting said first pressure on said mandrel when said first pressure passes through said first pressure responsive member thereby moving said mandrel in said first direction;

(d) exerting a second pressure on a second pressure responsive member;

(e) when said second pressure equals or exceeds a second threshold value which is greater than said first pressure, allowing said second pressure to pass through said second pressure responsive member; and (f) exerting said second pressure on said mandrel when said second pressure passes through said second pressure responsive member thereby moving said mandrel in said second direction.

8. The method of claim 7, wherein said first pressure responsive member is a first rupture disc, said second pressure responsive member is a second rupture disc, the allowing step (b) comprising the step of rupturing the first rupture disc thereby allowing said first pressure to pass therethrough, the allowing step (e) comprising the step of rupturing the second rupture disc thereby allowing said second pressure to pass threrethrough.

9. A method of operating a valve in a well tool adapted to be disposed in a borehole, said well tool including a mandrel connected to said valve, a first channel disposed through a wall of said tool and in fluid communication with a first portion of said mandrel, a second channel disposed through said wall of said tool and in fluid communication with a second portion of said mandrel, a first pressure responsive member disposed in said first channel, and a second pressure responsive member disposed in said second channel, comprising the steps of:

applying a first pressure to an annulus between said tool and a formation of said borehole when said tool is disposed in said borehole; and changing a state of said first pressure responsive member when said first pressure exceeds a first threshold value, said first pressure passing through said first pressure responsive member when said state is changed, said first pressure being exerted on said first portion of said mandrel, said mandrel moving in one direction thereby operating said valve from a first state to a second state.

10. The method of claim 9, further comprising the steps of:

applying a second pressure to said annulus when said tool is disposed in said borehole; and changing a state of said second pressure responsive member when said second pressure equals or exceeds a second threshold value which is greater than said first pressure, said second pressure passing through said second pressure responsive member when said state is changed, said second pressure being exerted on said second portion of mandrel, said mandrel moving in another direction thereby operating said valve from said second state to said first state.

11. A method of moving a mandrel, comprising the steps of:

(a) exerting a first pressure on a first pressure responsive member;

(b) when said first pressure exerted on said first pressure responsive member equals or exceeds a first predetermined threshold value, moving said mandrel in one direction;

(c) exerting a second pressure on a second pressure responsive member;

(d) when said second pressure exerted on said second pressure responsive member equals or exceeds a second predetermined threshold value, which is greater than said first pressure, moving said mandrel in another direction.

12. The method of claim 11, wherein said first pressure responsive member is a first rupture disc.

13. The method of claim 12, wherein, said first rupture disc ruptures when said first pressure equals or exceeds said first predetermined threshold value, said first rupture disc allowing said first pressure to be exerted on a first surface of said mandrel when said first rupture disc ruptures, and wherein the moving step (b) comprises the step of:

moving said mandrel in said one direction when said first pressure is exerted on said first surface of said mandrel.

14. The method of claim 13 wherein said second pressure responsive member is a second rupture disc.

15. The method of claim 14 wherein said second rupture disc ruptures when said second pressure equals or exceeds said second predetermined threshold value which is greater than said first pressure, said second rupture disc allowing said second pressure to be exerted on a second surface of said mandrel when said second rupture disc ruptures, and wherein the moving step (d) comprises the steps of:

moving said mandrel in said another direction when said second pressure is exerted on said second surface of said mandrel.

16. The method of claim 15, wherein a surface area of said second surface is greater than a surface area of said first surface.

17. A method of changing a state of a valve adapted to b disposed in a well tool, comprising the steps of:

(a) exerting a first pressure on a first pressure responsive member;

(b) when said first pressure exerted on said first pressure responsive member equals or exceeds a first predetermined threshold value, changing said state of said valve from a first state to a second state;

(c) exerting a second pressure on a second pressure responsive member; and (d) when said second pressure exerted on said second pressure responsive member equals or exceeds a second predetermined threshold value, which is greater than said first pressure, changing said state of said valve from said second state to said first state.

18. The method of claim 17, wherein said first state of said valve is a closed position, said second state of said valve being an open position.

19. The method of claim 17, wherein said first state of said valve is an open position, said second state of said valve being a closed position.

* * * * *